United States Patent [19]

Cohen

[11] Patent Number: 5,048,214

[45] Date of Patent: Sep. 17, 1991

[54] REVOLVER GRIP WITH CARTRIDGE STORAGE

[76] Inventor: Robert B. Cohen, 151-35 84th St., #2C, Howard Beach, N.Y. 11414

[21] Appl. No.: 660,782

[22] Filed: Feb. 25, 1991

[51] Int. Cl.[5] ..... F41C 23/10

[52] U.S. Cl. ..... 42/71.02

[58] Field of Search ..... 42/71.01, 71.02

[56] References Cited

U.S. PATENT DOCUMENTS

| | | | |
|---|---|---|---|
| 151,882 | 6/1874 | Jones | 42/71.02 |
| 394,376 | 12/1888 | Kelton | 42/71.01 |
| 711,989 | 10/1902 | Marble | 42/71.01 |
| 1,051,960 | 2/1913 | Kennedy | 42/71.01 |
| 1,110,209 | 9/1914 | Kirchner | 42/71.01 |
| 1,693,289 | 11/1928 | Warren | 42/71.01 |
| 2,476,355 | 7/1949 | Brown | 42/71.01 |
| 2,509,553 | 5/1950 | Wylie | 42/71.02 |
| 2,587,921 | 3/1952 | Suite | 42/71.01 |
| 2,605,033 | 7/1952 | Terry | 42/71.01 |
| 3,789,193 | 3/1974 | Hillberg | 42/71.01 |
| 4,697,368 | 10/1987 | Williams | 42/71.02 |

FOREIGN PATENT DOCUMENTS

| | | | |
|---|---|---|---|
| 14820 | 12/1885 | United Kingdom | 42/71.01 |

*Primary Examiner*—Richard W. Wendtland
*Attorney, Agent, or Firm*—Norman B. Rainer

[57] ABSTRACT

A modified grip panel for the handle portion of a revolver is provided with a thickened upper extremity having circular cylindrical bores that frictionally secure flanged cartridges. When attached to the revolver in the usual manner of a grip panel, the modified grip panel provides the user with readily available additional cartridges without impairing the normal function of the revolver.

6 Claims, 1 Drawing Sheet

REVOLVER GRIP WITH CARTRIDGE STORAGE

BACKGROUND OF THE INVENTION

1. Field of the Invention

This invention relates to firearms, and more particularly concerns a revolver grip adapted to store a plurality of spare cartridges.

2. Description of the Prior Art

Revolvers are standard equipment for police officers and security guards. Since most revolvers accommodate only six rounds of ammunition, additional cartridges are usually carried on a belt in loops, in pouches, or in speed loading devices.

Anyone having experience in the use of revolvers appreciates the inconvenience of locating the cartridges in a belt and withdrawing them, particularly when they have remained in the belt for a considerable period and become stuck or frozen. Practically every police officer at one time or another has been placed at serious disadvantage during an emergency due to the difficulty in withdrawing cartridges from the belt. During the winter months, heavy outerwear interferes with quick access to the cartridge belt.

Police Officers frequently encounter criminals armed with automatic weapons having a large number of cartridges, or multiple weapons. Officers carrying five or six shot revolvers are often at a disadvantage in such encounters. Officers have been killed while reloading by adversaries who still had cartridges in their weapons.

It is also common practice for a plainclothes or off-duty officer to carry a revolver in a concealed manner in an inside trouser holster or "bellyband". When a gunbelt with loops, pouches or speedloader is not worn, extra cartridges must be carried in a pocket or cartridge case, which is difficult to conceal. In crisis situations, spare cartridge accessability may be hindered. Furthermore, loose cartridges carried in a pocket are uncomfortable and may be easily lost.

Revolver handguns typically have a downwardly directed handle at the rear extremity upon which are removable grip panels which are grasped by the shooter while aiming and firing. The grip panels are usually of paired mirror image configuration, having facing surfaces which are in bolted contact with the handle of the revolver frame. Cartridges are typically characterized by having flanged rear extremities and a bullet projectile extending from the forward extremity.

Various devices have been disclosed in the prior art wherein extra cartridges are stored in compartments within the handle or grip panels. The prior art devices typically are designed to contain a complete reload for the revolver, usually consisting of six cartridges. The cartridges may be stored loose as shown in U.S. Pat. No. 2,509,553 or may be contained in a spare cylinder or speed loader, as shown in U.S. Pat. Nos. 151,882 and 4,697,368, respectively. Each of these devices utilizes an access door which requires that moving parts be manipulated in order to access spare cartridges. In combat situations, it is difficult to open the compartments. Moreover, the access doors have latches and hinges which may catch on clothing when the revolver is drawn from a concealed holster. Each of the devices adds significant weight and bulk to the revolver. The extra weight associated with six spare cartridges is difficult to carry in trouser holsters. Furthermore, the extra bulk of the handle creates a conspicuous bulge in ones clothing when concealed and furthermore radically changes the handling characteristics of the revolver. The extra weight and grith of the handle will alter the handling characteristics of the revolver and interfere with the shooter's accuracy and trigger control.

It is accordingly an object of the present invention to provide a revolver grip panel which will contain spare cartridges for emergency reloading.

In another object of the present invention to provide a grip panel of the aforesaid nature which utilizes no moving parts.

It is a further object of the present invention to provide a grip panel of the aforesaid nature which will not significantly increase the bulk and weight of the revolver.

It is yet another object of the present invention to provide a grip panel of the aforesaid nature which may be installed upon any revolver, which is simple to use and amenable to low cost manufacture.

SUMMARY OF THE INVENTION

The above and other beneficial objects and advantages are accomplished in accordance with the present invention by an improved grip panel adapted to be mounted upon a revolver having:

a) a cylinder adapted to rotatively hold a plurality of ammunition cartridges for sequential alignment with the breech of a barrel, and b) a handle portion rearwardly and downwardly disposed from said cylinder and adapted to be embraced by paired grip panels having mounting apertures which permit bolted engagement with the handle portion, said improved grip panel comprising: a) an integral structure bounded by inner and outer surfaces, upper and lower extremities and front and rear side edges, and b) a cartridge-receiving portion associated with said upper extremity and having parallel top and bottom surfaces and a plurality of parallel circular cylindrical bores of equal diameter communicating between said top and bottom surfaces, each of said bores adapted to secure a spare cartridge by frictional force.

In a preferred embodiment the grip panel is of monolithic construction, fabricated of a thermoplastic resin by an injection molding process. The plastic material is chosen so as to exhibit little dimensional change with variations in ambient temperature and relative humidity. Suitable plastics include engineering grade plastics such as nylon, polyacetal, polyester and polycarbonate. The cartridge-receiving portion is preferably configured as a thickened region of the grip panel, having three cylindrical bores in parallel disposition in a substantially vertical plane. The bores may be perpendicular to the axis of the barrel portion of the handgun, or may be angled slightly rearwardly, thereby forming an acute angle with respect to the axis of the barrel. The length of the bores is such that, when the flange of the cartridge is in abutment with the top surface of said cartridge-receiving portion, the nose or projectile portion of the cartridge protrudes below the bottom surface of said cartridge receiving portion.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 3:
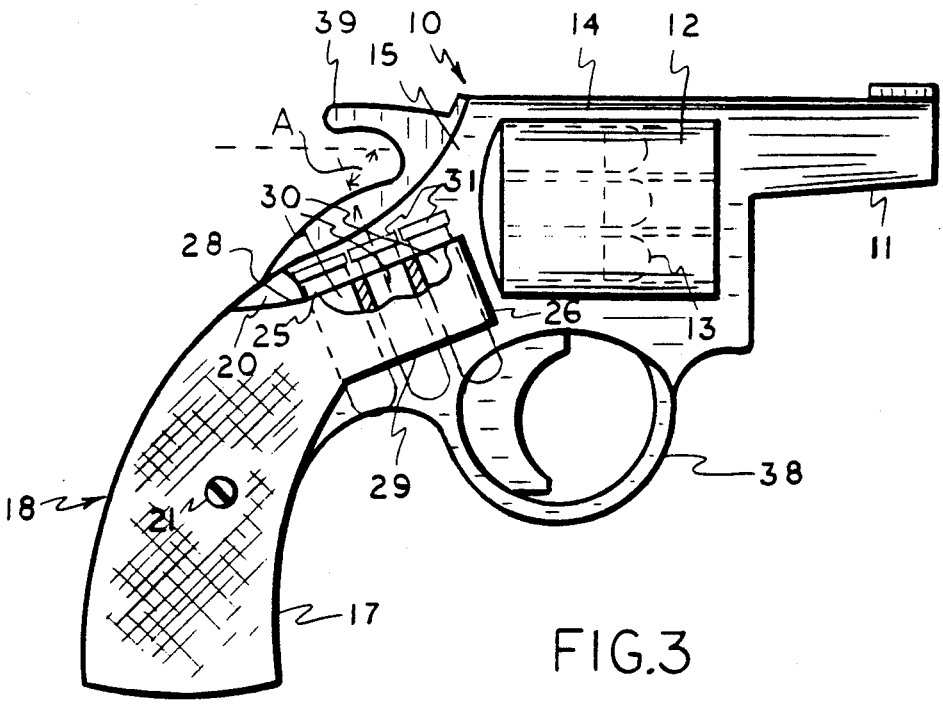
FIG. 3 is a side view of the cartridge-holding grip panel of FIG. 1 shown in operative joinder with a revolver handgun.

Referring to FIG. 3, an embodiment of the cartridge-holding grip panel 18 of the present invention is shown mounted upon revolver 10 having barrel portion 11 and cylinder 12 adapted to hold ammunition cartridges 13. Frame 14 has substantially parallel side walls 15 rearwardly disposed from cylinder 12, and handle portion 17 rearwardly and downwardly disposed from frame 14. Handle portion 17 is adapted to be embraced by the cartridge-holding grip panel 18 of this invention, and conventional grip panel 19.

Figure 2:
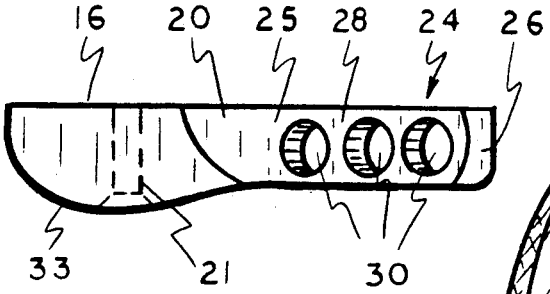
FIG. 2 is a top view of the embodiment of FIG. 1.
Figure 1:
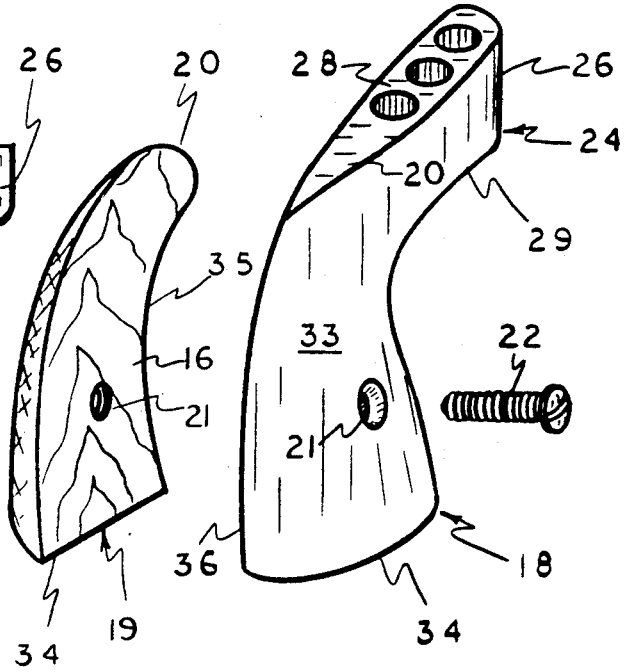
FIG. 1 is a perspective view of an embodiment of the cartridge holding grip panel of the present invention, shown in paired association with a conventional grip pannel.

As shown more clearly in FIGS. 1 and 2, said panels have inner and outer surfaces 16 and 33, respectively, upper and lower extremities 20 and 34, respectively, front and rear side edges 35 and 36, respectively, and aligned mounting appertures 21. Grip panels 18 and 19 are attached to handle portion 17 by means of bolt 22.

Grip panel 18 of the present invention has cartridge-receiving portion 24 having rear extremity 25 which blends into upper extremity 20 of said grip panel, and forward extremity 26 configured to be disposed upon side wall 15 rearwardly of cylinder 12. Cartridge-receiving portion 24 has substantially flat, parallel upper and lower surfaces 28 and 29, respectively, and circular cylindrical bores 30 communicating between surfaces 28 and 29. Bores 30 are adapted to each embrace a spare cartridge 31 in close frictional conformity. The length of the bores, measured between upper and lower surfaces 28 and 29, respectively, is smaller than the total length of the cartridges which are accommodated by said bores. The angle of inclination of the axis of bores 30 with respect to barrel 11, and represented by angle A in FIG. 3, may range between about 35 and 90 degrees.

In the case of police enforcement revolvers typically employing cartridges of between about 38 and 45 caliber, three bores are preferably employed to hold three extra cartridges. In such instances, it has been found that if angle A exceeds 90 degrees, the forward-most cartridges may interfere with the shooter's hand, or trigger housing 38. If angle A is less than 35 degrees, the cartridges may interfere with the shooter's ability to utilize his thumb to manipulate hammer 39 of the revolver. The grip panel of this invention may be adapted to accommodate either side of the handle of the revolver, provided it does not interfere with proper functioning of the revolver.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A cartridge-holding grip panel adapted to be mounted upon a revolver having:

a) a cylinder that rotatively holds a plurality of ammunition cartridges for sequential alignment with a breech of the barrel, and b) a handle portion rearwardly and downwardly disposed from said cylinder and adapted to be embraced by paired grip panels having mounting apertures which permit bolted engagement with the handle portion, said cartridge-holding grip panel adapted to serve as one of said paired grip panels and comprising: a) an integral structure bounded by inner and outer surfaces, upper and lower extremities and front and rear side edges, and b) a cartridge-receiving portion associated with said upper extremity and having substantially parallel top and bottom surfaces and a plurality of parallel circular cylindrical bores of equal diameter communicating between said top and bottom surfaces, each of said bores adapted to secure a spare cartridge by frictional force.

2. A cartridge-holding grip panel of claim 1 of monolithic construction.

3. The cartridge-holding grip panel of claim 2 fabricated of a thermoplastic resin by an injection molding process.

4. The cartridge-holding grip panel of claim 1 wherein said cartridges are flanged, and a length of said bores is such that, when a flange of said spare cartridge is in abutment with said top surface of said cartridge-receiving portion, a projectile portion of said spare cartridge protrudes below said bottom surface of said cartridge receiving portion.

5. The cartridge-holding grip panel of claim 1 wherein said plurality of bores is three bores.

6. The cartridge-holding grip pannel of claim 1 wherein an angle of inclination of an axis of said bores with respect to said barrel of said revolver is between 35 and 90 degrees.

* * * * *